United States Patent [19]

Johnsen

[11] Patent Number: 4,907,985

[45] Date of Patent: Mar. 13, 1990

[54] SAFETY TWIST LOCK CONNECTOR FOR AN EXTENSION POWER CORD

[76] Inventor: Cary T. Johnsen, 233 Neptune St., Encinitas, Calif. 92024

[21] Appl. No.: 370,992

[22] Filed: Jun. 26, 1989

[51] Int. Cl.[4] ..... H01R 13/625

[52] U.S. Cl. ..... 439/369; 439/337

[58] Field of Search ..... 439/337, 369, 660, 670, 439/671, 673, 685, 174, 677, 284, 925; D13/17, 24, 28, 29, 30

[56] References Cited

U.S. PATENT DOCUMENTS

D. 301,335 5/1989 Audrain ..... D13/28

4,221,449 9/1980 Shugart, Jr. ..... 439/369

*Primary Examiner*—Eugene F. Desmond

*Assistant Examiner*—Walter G. Hanchak

*Attorney, Agent, or Firm*—Frank D. Gilliam

[57] ABSTRACT

The twist lock connector of the invention includes an UL approved conventional twist to connect male and female mating ends of a pair of extension power cords for temporary supplying AC power to a work site or the like from a remote power source. The mating plugs of the first embodiment are triangular in cross-section and when connected one of the flat side surfaces rests on the support surface. In a second embodiment the mating plugs when connected have a semi-circular cross-section with the flat surface resting on the support surface. In a third embodiment, the mating plugs when connected form a rectangular cross-section. One of the larger surfaces rests on the support surface when the power cords are in use. In each of the three embodiments, the mating plugs taper or down scale in dimension toward their respective extension power cords.

8 Claims, 1 Drawing Sheet

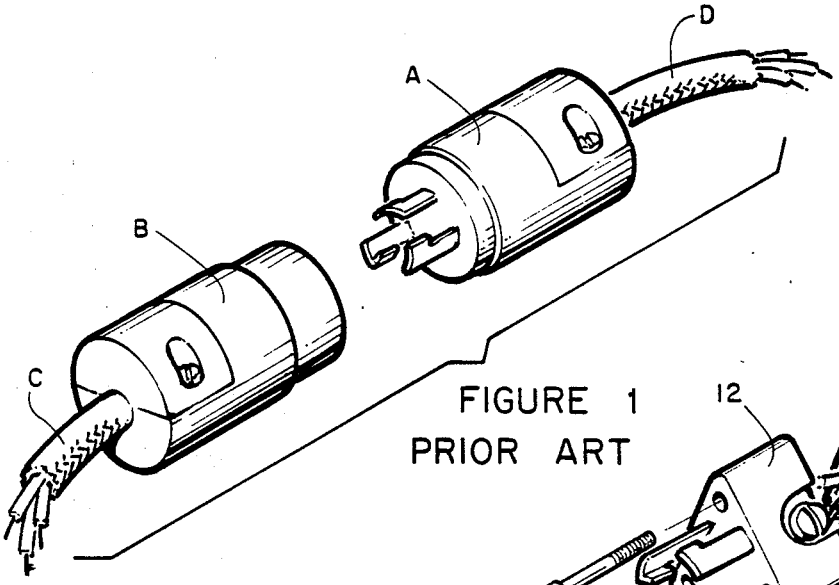
FIGURE 1
PRIOR ART
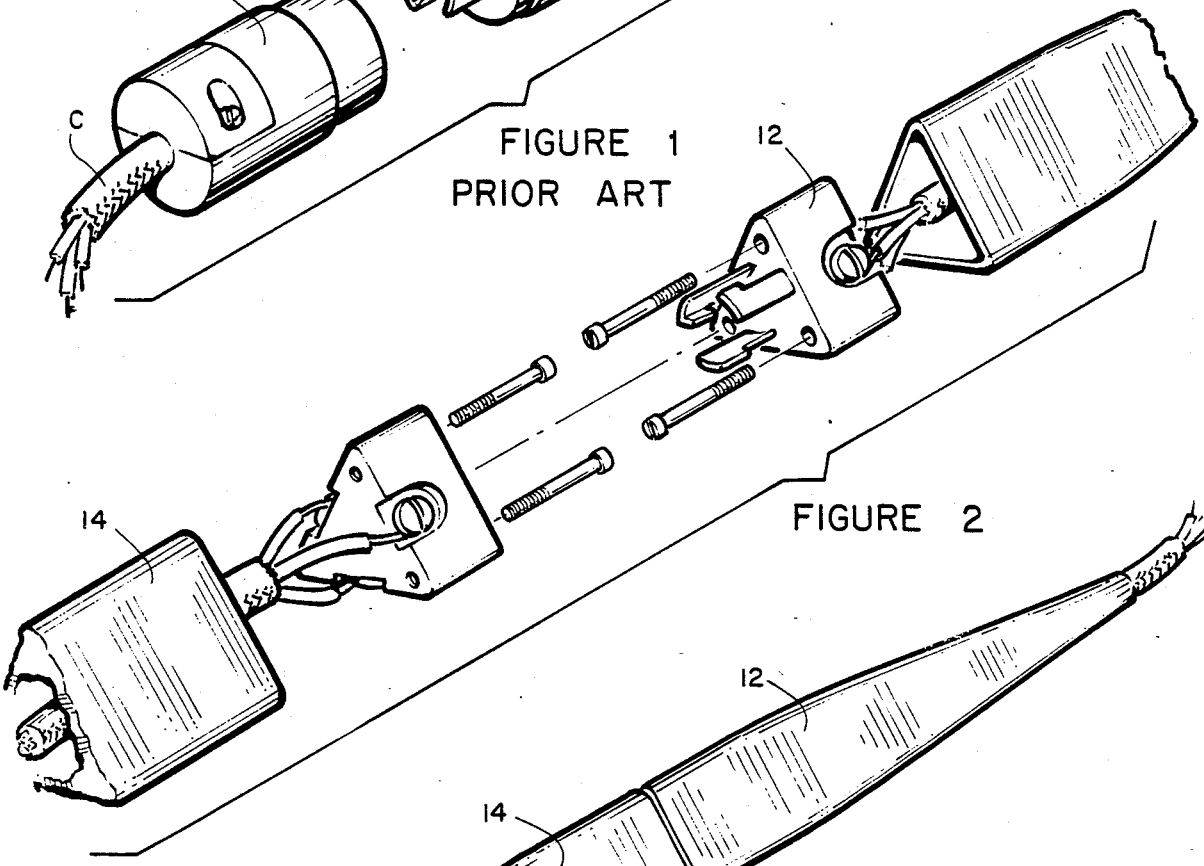
FIGURE 2
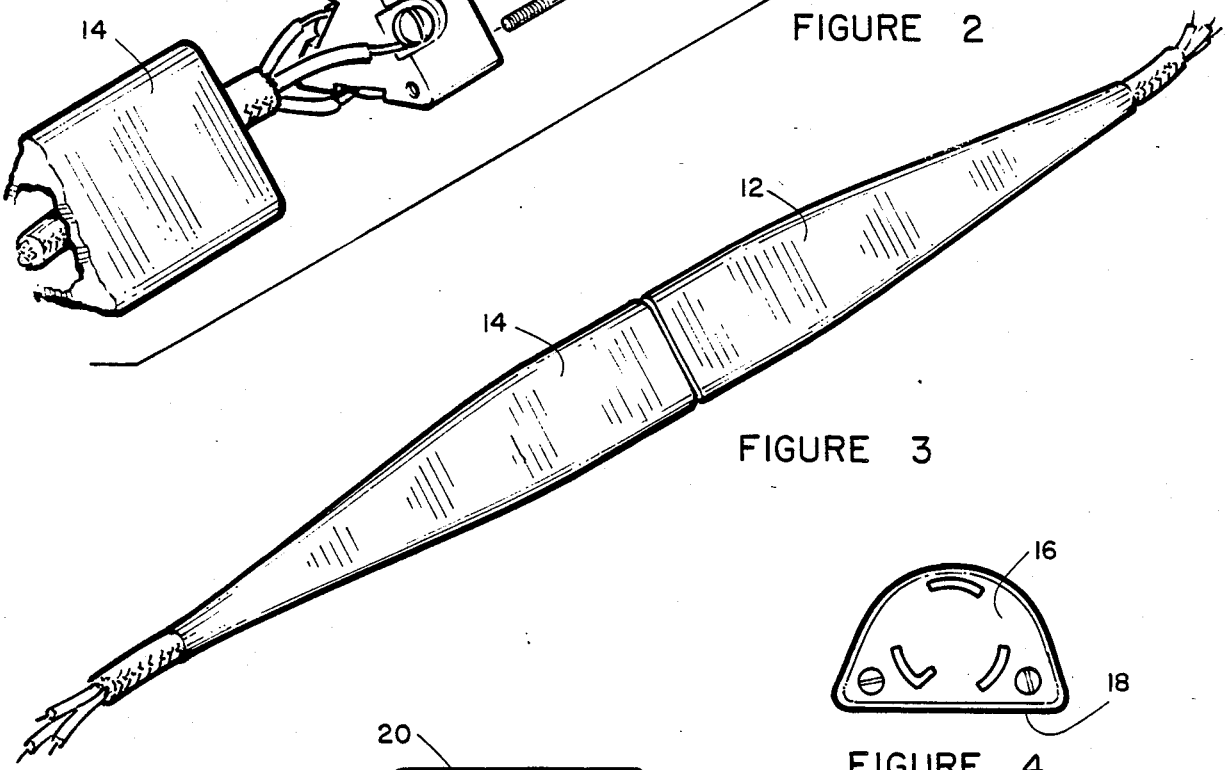
FIGURE 3
FIGURE 4
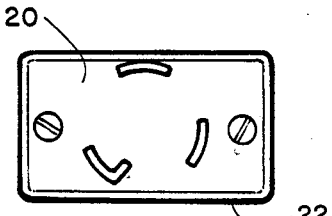
FIGURE 5

SAFETY TWIST LOCK CONNECTOR FOR AN EXTENSION POWER CORD

BACKGROUND OF THE INVENTION

This invention is directed to extension cords and more particulary to the attachment means for interconnecting lengths of heavy duty extension power cords for temporary use in building construction and the like where the power source is distant from the work site.

Typical connectors for this use can be found in U.S. Pat. Nos. 3,023,394; 3,148,930; 3,183,474; 3,945,702 and 4,173,383. As can be readily understood, all of the noted connectors are cylindrical in configuration with a generally circular cross-section.

U.S. Pat. Nos. 3,605,059 and 4,199,207 generally teach the interconnecting of the typical connectors discussed above and the specific similarly configured connectors of the referenced patents.

There is no doubt that this general type of power cord interconnector has found great acceptance in the electrical art as a safe means electrically to interconnect extension power cords and the like.

The safety of personnel working in the generally area of an extension cord using the prior art inter-connectors although protected from electrical injury are not protected from tripping and falling or the like when inadvertently stepping on a cylindrical power cord interconnect which is caused to rotate throwing that person off balance. A power cord interconnect that will not rotate when inadvertently stepped on should find wide acceptance in the building trades and other arts.

SUMMARY OF THE INVENTION

The preferred embodiments of the power cord connectors of the present invention take three forms, namely, triangular, semi-circular and rectangular. As can be readily understood, when a work person steps on one of the connectors of the present invention the connector will not rotate and the work person will not loose his or her balance as normally expected when stepping on the conventional cylindrical connectors that are presently available. Also the configuration of the connectors of the present invention prevent them from catching on objects that they may be drug over for placement in position for use. The connectors of the three preferred embodiments have the largest dimension at the male and female plug interconnect end and scale downward in dimension in a linearly smooth manner while maintaining the same configuration in a direction toward the power cord to which they are connected.

An object of this invention is to provide a electrical power cord interconnect which is safe for a worker to inadvertent step on.

Another object of this invention is to provide interconnecting twist to lock connectors for heavy duty AC extension cords that do not rotate when stepped upon.

Still another object of this invention is to provide a power cord that can be drug into position and will not catch on objects that it may be drug over.

Other objects and advantages of the invention will become apparent and will be more clearly understood from the following description when read in connection with the accompanying drawing figures.

BRIEF DESCRIPTION OF THE DRAWING FIGURES

FIG. 1 is a perspective showing of a typical AC power cord inter-connector plugs of the prior art;

FIG. 2 is a perspective showing of a first embodiment of the AC inter-connector plugs of the invention disassembled;

FIG. 3 is a perspective showing of the AC connectors of the first embodiment assembled for use;

FIG. 4 is a an end view showing of a second embodiment of the AC connectors of the invention; and FIG. 5 is an end view showing of a third embodiment of the AC connectors of the invention.

DETAILED DESCRIPTION OF THE PREFERRED EMBODIMENTS OF THE INVENTION

Referring now specifically to the prior art showing of FIG. 1, In this Figure a pair of twist lock male and female connectors A and B respectfully, shown separated, which are used to provide an extension D to the length of the AC power cord C. As can be noted the connectors A and B are cylindrical with a circular cross-sectional configuration greater in cross-sectional area than the power cords C and D. It should be obvious that on a support surface 10, such as wood, cement, or the like, the connectors A and B will rotate when stepped upon. This rotation has been the clause of many industrial accidents to workers carrying loads of material or the like inadvertently stepping on the connectors which rotate causing the worker to possibly fall. The present invention eliminates this cause of industrial accidents.

Referring now specifically to drawing FIGS. 2 and 3 wherein a first embodiment of the AC power cord connectors 12 and 14 of the present invention is shown. The first embodiment and the embodiments to follow are shown utilizing a twist to lock mating male and female interconnect as taught by the prior art or otherwise. It should be understood that any convenient type of connector may be used to practice this invention. As shown in the drawing FIGS. 2 and 3 the connectors are configured triangular in cross-section so that when they mate each connector appears to be a continuation of the other. The distal end of each of the connectors 12 and 14 have the greatest cross-sectional dimension. This cross-sectional dimension uniformly tapers downwardly in cross-section toward the AC power cord to which they are attached and at the power cord are substantially the same dimension as the power cord.

It should be apparent that when the connector is resting on one of its flat sides it is difficult to rotate the connector and the connector will not rotate when a worker steps thereon.

The embodiment as shown in drawing FIG. 4 comprises mating connectors 16 as above described which have a semi-circular cross-section which linearly scales down in the same manner. As mentioned above, the connector will not rotate when stepped on by a worker when the connector is resting on it flat surface 18.

The embodiment as shown in drawing FIG. 5 comprises connectors 20 that are rectilinear in cross-section with the larger surfaces 22 of the connectors being the resting surface. As mentioned above, the connector will not rotate when stepped on by a worker.

In addition, all of the configurations of the above embodiments are designed such that when the workers drag these extension cords into position for temporary use they do not catch on objects that they may be drug over.

The various connectors of the invention may be assembled as shown in FIG. 2 or in any other conventional manner.

While three preferred embodiments of the invention have been illustrated and described, it will be understood that various changes and modifications may be made therein by persons skilled in the art without departing from the scope or spirit of the invention disclosed.

What is claimed is:

1. Safety interlocking connectors for temporary extension power cords comprising:

a first female connector attached to a first extension power cord at a first end; and a second male connector attached to a second extension power cord at a first end, said first and second connectors mate at their distal ends to interconnect said first and second extension power cord, said first and second connectors have at least one flat resting surface and their largest dimension configuration is at their distal ends and are linearly scaled downward in that same configuration toward said first ends.

2. The invention as defined in claim 1 wherein said first and second connectors have a triangular cross-section at their distal ends.

3. The invention as defined in claim 1 wherein said first and second connectors have a semi-circular cross-section at their distal ends.

4. The invention as defined in claim 1 wherein said first and second connectors have a rectangular cross-section at their distal ends.

5. The invention as defined in claim 1 wherein said at least one flat surface on said first and second connectors are coplanar.

6. The invention as defined in claim 2 wherein said at least one flat surface on said first and second connectors are coplanar.

7. The invention as defined in claim 3 wherein said at least one flat surface on said first and second connectors are coplanar.

8. The invention as defined in claim 4 wherein said at least one flat surface on said first and second connectors are coplanar.

* * * * *